United States Patent [19]

Meier

[11] 4,276,839

[45] Jul. 7, 1981

[54] NEEDLE BAR PENDULUM FOR SEWING MACHINES

[75] Inventor: Willi Meier, Karlsruhe-Durlach, Fed. Rep. of Germany

[73] Assignee: Dorina Nahmaschinen GmbH, Fed. Rep. of Germany

[21] Appl. No.: 51,161

[22] Filed: Jun. 22, 1979

[30] Foreign Application Priority Data

Jul. 5, 1978 [DE] Fed. Rep. of Germany ..... 2829497

[51] Int. Cl.[3] ..... D05B 55/06

[52] U.S. Cl. ..... 112/227

[58] Field of Search ..... 112/109, 111, 158 R, 112/221, 227, 73, 158 A, 158 B, 158 C, 158 D

[56] References Cited

U.S. PATENT DOCUMENTS

| | | | |
|---|---|---|---|
| 331,106 | 11/1885 | Arnold | 112/158 R X |
| 1,193,803 | 8/1916 | Loeb | 112/158 R |
| 3,036,534 | 5/1962 | Martines | 112/111 |
| 3,541,981 | 11/1970 | Watson | 112/158 R |
| 3,580,199 | 5/1971 | Vigorelli | 112/158 R |

FOREIGN PATENT DOCUMENTS

| | | | |
|---|---|---|---|
| 1115764 | 1/1956 | France | 112/227 |

*Primary Examiner*—Wm. Carter Reynolds
*Attorney, Agent, or Firm*—McGlew and Tuttle

[57] ABSTRACT

A needle bar pendulum for a sewing machine comprises a carrier bar which has a bearing engagement end at each end which are terminated by a shoulder in a central portion of the carrier bar and separate bearing members are engaged over each end of the carrier bar. For this purpose the bearing members have bores therethrough for accommodating the respective ends of the carrier bar and they also have a bore therethrough for the needle bar. The bearings are advantageously joined to the carrier bar in a permanent manner such as by a cementing or welding of the bearings in position after they are engaged thereon.

3 Claims, 2 Drawing Figures

Fig. 1
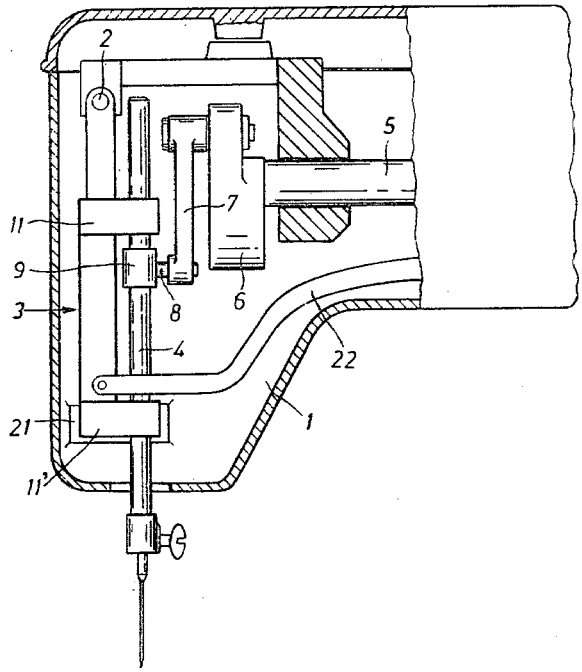
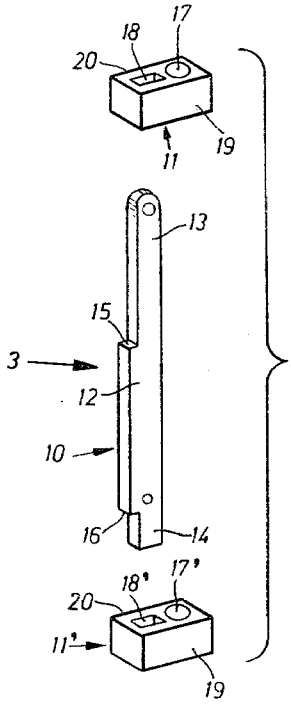
Fig. 2

NEEDLE BAR PENDULUM FOR SEWING MACHINES

BACKGROUND OF THE INVENTION

1. Field of the Invention

This invention relates in general to the construction of sewing machines and in particular to a new and useful needle bar pendulum for sewing machines which includes a carrier bar engaged at respective ends with respective separate first and second bearing members which have bores therethrough which engage over the carrier bar and which have another bore for the passage of the needle bar.

2. Description of the Prior Art

The presently known needle bar pendulums are made of one piece to ensure a parallel alignment of the bearing bores for the needle bar and a bore perpendicular thereto for the pendulum axis. Due to the complex design of this pendulum, such an arrangement is energy consuming and therefore costly.

SUMMARY OF THE INVENTION

The invention is based on the problem of providing a needle bar pendulum which ensures exact bearing alignment in a simple manufacture. In accordance with the invention a needle bar pendulum for a sewing machine comprises a carrier bar with separate first and second bearing members which are engaged over respective segmental ends thereof up to shoulders which are formed at each end of a center portion. The separate bearings include bores for the passage of the carrier bar as well as bores for the passage of the needle bar. This permits a construction that facilitates the manufacture. The assembly of the needle bar pendulum from several parts permits the use of different materials, e.g. light metal for the carrier and sintered material for the bearings, and thus an additional improvement of the operating properties of the needle bar pendulum.

In order to keep the shearing forces on the connecting surface between the bearings and the carrier low, the cross sections of the segments of the carrier and of the passages of the bearings have a form deviating from the circular form.

Accordingly it is an object of the invention to provide a needle bar pendulum for sewing machines which comprises a carrier bar having a bearing engagement end at each end with first and second separate bearing members each having a carrier bar bore therethrough through which respective engagement ends of the carrier bar engage and wherein each of the bearing members has a needle bar bore therethrough for the passage of a needle bar.

A further object of the invention is to provide a needle bar pendulum for sewing machines which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

BRIEF DESCRIPTION OF THE DRAWINGS

In the Drawings:

FIG. 1 is a front elevation view partly in section of a head of a sewing machine constructed in accordance with the invention; and FIG. 2 is an exploded perspective view of a needle bar pendulum used in the sewing machine of FIG. 1.

DESCRIPTION OF THE PREFERRED EMBODIMENTS

Referring to the drawings in particular, the invention embodied therein, comprises, a needle bar pendulum for a sewing machine such as the sewing machine shown in FIG. 1 which includes a head portion 1. In head 1 is mounted by means of a bearing pin 2 a needle bar pendulum 3 in which a displaceable needle bar 4 is received. In head 1 is furthermore mounted an arm shaft 5 on which is secured a crank 6. The crank 6 is connected through a guide rod 7 and a hinge pin 8 with a clamp 9 secured on needle bar 4.

Needle bar pendulum 3 consists, as shown in FIG. 2, of a carrier 10 and of two bearings 11 and 11'. Carrier 10 is designed as a bar with a rectangular cross section. It has a central portion 12 and two outer or upper and lower segments or bearing engagement ends 13 and 14, which are reduced in their cross section relative to central portion 12, so that stops or shoulders 15 and 16 are formed.

Bearings 11 consists of rectangular blocks which each have a needle bar bore 17, (17') for needle bar 4 and a rectangular passage 18, (18') which are in registry with the respective upper and lower segments 13 and 14 of carrier 10.

Bearings 11 and 11' are bounded by two parallel outer side walls 19 and 20, which are parallel to the axis of bores 17, 17' and passages 18, 18'.

The lower bearing 11' is guided in a groove 21 provided in head 1, of which only one side wall is shown in FIG. 1. Needle bar pendulum 3 is connected by a guide rod 22 with a known zig-zag attachment which turns it about bearing pin 2.

For assembling needle bar pendulum 3, bearings 11 and 11' are pushed over respective outer segments 13 and 14 of carrier 10 up to stops 15 and 16. Subsequently, needle bar 4 is introduced into bores 17, 17'. Needle bar 4 then aligns bearings 11, 11' in their later position. The bearing surface of needle bar pendulum 3 in the range of its swivel axis, and the lower bearings 11' are then aligned parallel to each other and braced by placing them on corresponding supporting surfaces. Between the contacting walls of passages 18, 18' of bearings 11 and 11' and segments 13 and 14 of carrier 10 is introduced a hardenable non-shrinking adhesive, preferably an epoxy, so that bearings 11' are permanently joined with carrier 10 in the aligned position.

Instead of the rectangular cross section of segments 13 and 14 of carrier 10 and the corresponding passages 18 in bearings 11, a round cross section can also be selected. It may be advisable to supplement the known adhesive joint by a known groove and tongue joint between carrier 10 and bearings, 11'.

While specific embodiment of the invention has been shown and described in detail to illustrate the application of the principles of the invention, it will be understood that the invention may be embodied otherwise without departing from such principles.

What is claimed is:

1. A needle bar pendulum for sewing machines, comprising a carrier bar having a bearing engagement end at each end, first and second separate bearing members each having a carrier bar bore therethrough through which respective engagement ends of said carrier bar engage and are connected by adhesive, each of said first and second bearing members having a needle bar bore therethrough for the passage of a needle bar, each of said needle bar bores and carrier bar bores of each said bearing members being substantially parallel to each other.

2. A needle bar pendulum according to claim 1 wherein said carrier bar includes a central widened portion between said respective engagement ends of said carrier bar defining a shoulder abutment adjacent each end of said engagement ends, said respective first and second bearing members being engaged against respective shoulder abutments of said central portion.

3. A needle bar pendulum according to claim 1 wherein said carrier bar bores through said respective bearing members have a cross section other than circular.

* * * * *